US010155619B2

(12) United States Patent
Stabler et al.

(10) Patent No.: US 10,155,619 B2
(45) Date of Patent: Dec. 18, 2018

(54) CHEMICAL RESISTANT EVAPORATION CONTROL STRUCTURES

(71) Applicant: Arkema Inc., King of Prussia, PA (US)

(72) Inventors: Sean M. Stabler, Pottstown, PA (US); Leo T. Hutton, Wetmore, CO (US); David A. Seiler, Garnet Valley, PA (US)

(73) Assignee: Arkema Inc., King of Prussia, PA (US)

( * ) Notice: Subject to any disclaimer, the term of this patent is extended or adjusted under 35 U.S.C. 154(b) by 409 days.

(21) Appl. No.: 14/893,568

(22) PCT Filed: May 28, 2014

(86) PCT No.: PCT/US2014/039644

§ 371 (c)(1),
(2) Date: Nov. 24, 2015

(87) PCT Pub. No.: WO2014/193870

PCT Pub. Date: Dec. 4, 2014

(65) Prior Publication Data

US 2016/0101932 A1 Apr. 14, 2016

Related U.S. Application Data

(60) Provisional application No. 61/828,290, filed on May 29, 2013.

(51) Int. Cl.

| | |
|---|---|
| ***B65D 88/34*** | (2006.01) |
| ***B65D 88/36*** | (2006.01) |
| ***E04H 4/08*** | (2006.01) |

(52) U.S. Cl.
CPC ..... *B65D 88/34* (2013.01); *B65D 88/36* (2013.01); *E04H 4/08* (2013.01)

(58) Field of Classification Search
CPC ..... B65D 88/34; B65D 88/36; E04H 4/08
See application file for complete search history.

(56) References Cited

U.S. PATENT DOCUMENTS

| | | | |
|---|---|---|---|
| 3,938,228 | A | 2/1976 | Kemkers et al. |
| 3,993,215 | A | 11/1976 | Usab |
| 3,998,204 | A | 12/1976 | Fuchs et al. |
| 5,106,910 | A | 4/1992 | Weidman et al. |
| 8,019,208 | B2 | 9/2011 | Altman et al. |
| 8,099,804 | B2 | 1/2012 | Gregg |

(Continued)

FOREIGN PATENT DOCUMENTS

| | | |
|---|---|---|
| GB | 949771 | 8/1960 |
| WO | WO2005/108299 | 11/2005 |

*Primary Examiner* — Michael C Miggins
(74) *Attorney, Agent, or Firm* — Thomas F. Roland

(57) ABSTRACT

The invention relates to chemically resistant structures that float on top of a liquid to reduce the level of evaporation from the liquid. The liquid could be in a small container or vat, or in a larger pool, pond, or reservoir. The structure is preferably a foamed material of a polyamide or fluoropolymer, or may be a hollow or foamed structure having a polyamide or fluoropolymer outer layer. The structures covering the liquid may consist of a single structure or two or more discrete structures that partially or fully cover the surface of a liquid. The covering is especially useful where the fluid contains toxic, reactive or corrosive substances. One preferred structure is a polyvinylidene fluoride foam structure (such as a KYNAR from Arkema Inc) at about 0.1-36 inches in length/diameter.

12 Claims, 1 Drawing Sheet

(56) References Cited

U.S. PATENT DOCUMENTS

| | | | |
|---|---|---|---|
| 8,277,913 | B2 | 10/2012 | Henry et al. |
| 8,342,352 | B2 | 1/2013 | Alirol |
| 8,393,486 | B2 | 3/2013 | Cap et al. |
| 2006/0108269 | A1 | 5/2006 | Smith |
| 2006/0133983 | A1 | 6/2006 | Charles et al. |
| 2012/0045603 | A1 | 2/2012 | Zerafati et al. |

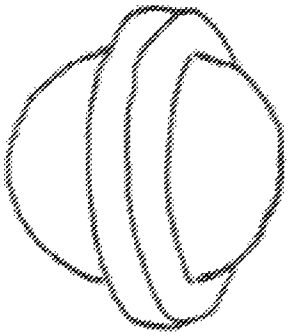

CHEMICAL RESISTANT EVAPORATION CONTROL STRUCTURES

This application claims benefit, under 35 U.S.C. § 120 or § 365 of PCT Application Number PCT/US2014/039644, filed May 28, 2014; and US Provisional Application No. 61/828,290, filed May 29, 2013; said applications incorporated herein by reference.

FIELD OF THE INVENTION

The invention relates to chemically resistant structures that float on top of a liquid to reduce the level of evaporation from the liquid. The liquid could be in a small container or vat, or in a larger pool, pond, or reservoir. The structure is preferably a foamed material of a polyamide or fluoropolymer, or may be a hollow or foamed structure having a polyamide or fluoropolymer outer layer. The structures covering the liquid may consist of a single structure or two or more discrete structures that partially or fully cover the surface of a liquid. The covering is especially useful where the fluid contains toxic, reactive or corrosive substances. One preferred structure is a polyvinylidene fluoride foam structure (such as a KYNAR from Arkema Inc) at about 0.1 to 36 inches in length/diameter.

BACKGROUND OF THE INVENTION

Preventing or reducing evaporation from bodies of water is a key aspect of water conservation. Water lost through evaporation cannot be easily replaced, and is not available for use by human beings, for mining, farming or industrial uses. In many cases, water is collected in surface reservoirs and ponds. Many solutions have been put into place to at least partially cover the surface of these bodies of water, thereby limiting evaporation. The solutions have included floating covers, discrete floating modules, and chemical monolayers. Each of these methods has advantages and disadvantages. Floating covers, generally a single sheet of material, are effective at covering a large percentage of the surface, but are difficult to manipulate on large bodies of water. Chemical monolayers are inexpensive, but less effective at reducing evaporation, and can be difficult to separate from the water. Discrete floating elements can be used on large bodies of water, are easy to add and remove, but typically have limited coverage. Commonly used floating elements include hollow plastic spheres, often referred to as "bird balls". These have limited effectiveness, since the ball shape leaves gaps between adjacent balls. In addition to the prevention of evaporation, coverings may provide a thermal insulation, and also retard the growth of organisms at the water/air interface.

Many designs for these discrete floating elements have been proposed to provide maximum surface coverage, while also addressing the issues of overlap (which wastes material), and the effect of the wind in pushing the individual elements into clumps. Several patents suggest novel, complicated designs, including U.S. Pat. No. 3,938,338 (hexagonal hollow float), U.S. Pat. No. 8,019,208 (round, overlapping discs), U.S. Pat. No. 8,099,804 (hexagonal or octagonal hollow pyramid-shapes). U.S. Pat. No. 8,3442,352 (hexagonal hollow disks that allow water into the lower portion), and U.S. Pat. No. 8,393,486 (aerodynamical hexagonal float)

The discrete floating elements described in the art generally are made with a polyolefin (polypropylene, high density polyethylene shell), and may have a polystyrene or polyurethane foam in the interior for added buoyancy. Polystyrene beads, sheets and other shapes can also be used. UV stabilizers are often used to prevent deterioration from UV light exposure. Carbon black may be added for improved UV resistance, or white pigment (like $TiO_2$) to reduce absorbed solar energy.

In addition to use on bodies of water, floating covering elements also find use as coverings for other liquids, including but not limited to chemical production, anodizing baths, galvanizing baths, plating baths, dyeing baths, sewage treatment, oil waste, and waste ponds containing chemical or toxic substances.

Environmental agencies, such as the US EPA, have been concerned with the noxious odors, and hazards associated with evaporation from many of these chemical and waste ponds.

Problems with the polyolefins, polystyrene, and polyurethanes currently used as fluid coverings is that they have limited chemical resistance, and tend to react and deteriorate when exposed to acids, bases, oxidizers and other strong and highly reactive chemicals. These polymers have relatively poor resistance to UV radiation. Additionally, these polymers are quite flammable.

Fluoropolymers, and polyvinylidene fluoride (PVDF) in particular, are known for their high chemical, weathering, permeation and flammability resistance. Unfortunately, at a density of 1.77 g/cm$^3$, PVDF does not readily float on water or many other fluids. Polyamides also have a high degree of resistance to many chemicals, though not good as for fluoropolymers. At a density of 1.13-1.35 g/cm$^3$, these materials also would fail to float on water, or most other fluids.

Hollow floating polyvinylidene fluoride spheres had been proposed for this application, though the complicated manufacturing process and cost of solid PVDF made the use of these PVDF spheres use as liquid coverings undesirable.

U.S. Pat. No. 8,277,913 and US 2012-0045603 describe self-supporting foamed fluoropolymer structures. Through the use of special foaming techniques, it is possible to produce a foamed fluoropolymer structure having a density below the target density of the fluid needing coverage (i.e. below 1.0 g/cm$^3$ for water). US 2013-0108816 describes foamed fluoropolymer foam-core structures.

It has now been found that floating structures having a fluoropolymer or polyamide outer layer can be used as a covering to solve the problem of evaporation from industrial fluid baths and chemical waste ponds. These structures work over a broad pH range, with most chemical solvents and corrosive chemicals. The structures of the invention provide superior chemical resistance, flame resistance and weathering resistance, and will last much longer than polymers typically used in these applications. The floating structure could be, for example, a foamed fluoropolymer, a foamed polyamide, a hollow fluoropolymer or polyamide structure—preferably a foamed hollow structure, or a multi-layer structure having a fluoropolymer or polyamide layer as the outermost layer—such as a polyamide or fluoropolymer coated thermoplastic.

In addition to reducing the evaporation from bodies of fluids, the floating structures of the invention also aid in the thermal insulation (to prevent the fluid body from cooling or warming), prevents splashing when an object is placed into a bath, and prevents misting from a chemical reaction within the bath that releases bubbles. The use of foamed structures reduces costs, as less material is required, and increases the flexibility of the structures.

SUMMARY OF THE INVENTION

The invention relates to a chemical resistant floating structure, having as the outermost layer of the structure a fluoropolymer or a polyamide.

The invention further relates to a partially or fully covered body of liquid, where the liquid has one or more of the fluoropolymer or a polyamide structure floating on it. Preferably the floating structure is either a foamed structure, a coated structure, or a multi-layer structure.

The invention further relates to a method of reducing the evaporation from a liquid body involving partially or fully covering the liquid body with one or more floating polyamide or fluoropolymer structures

BRIEF DESCRIPTION OF THE DRAWINGS

FIG. 1 represents the structure made by the process of Example 4.

DETAILED DESCRIPTION OF THE INVENTION

The invention relates to a structure or structures having a surface layer that is a fluoropolymer or polyamide, and that float on top of a fluid to prevent evaporation.

Percentages, as used herein are weight percentages, unless otherwise noted, and molecular weight are weight average molecular weight as measured by a GPC, unless otherwise noted. US patents included in this description are incorporated herein by reference.

The invention will be illustrated by referring to polyvinylidene fluoride (PVDF), however, one of ordinary skill in the art would recognize that other fluoropolymers (especially thermoplastic fluoropolymers), as well as polyamides could be substituted for the PVDF in the practice of the invention.

Fluoropolymer

The fluoropolymers of the invention include, but are not limited to polymers containing at least 50 weight percent of one or more fluoromonomers. The term "fluoromonomer" as used according to the invention means a fluorinated and olefinically unsaturated monomer capable of undergoing free radical polymerization reaction. Suitable exemplary fluoromonomers for use according to the invention include, but are not limited to, vinylidene fluoride, vinyl fluoride, trifluoroethylene, tetrafluoroethylene (TFE), ethylene tetrafluoroethylene, and hexafluoropropylene (HFP) and their respected copolymers. Preferred fluoropolymers are a polyvinylidene fluoride homopolymer or copolymer, chlorotrifluoroethylene (CTFE), perfluorinated ethylene-propylene copolymer (EFEP), ethylene-tetrafluoroethylene (ETFE), ethylene-chlorotrifluoroethylene (ECTFE), copolymers of tetrafluoroethylene and hexafluoropropene, perfluoroalkoxy copolymer (PFA), polytetrafluoroethylene-perfluoromethylvinyl ether, and polytetrafluoroethylene homopolymer or copolymers. Fluoro-terpolymers are also contemplated, including terpolymers such as those having tetrafluoroethylene, hexafluoropropene and vinylidene fluoride monomer units.

Useful thermoplastic fluoropolymers for foam formation include, but are not limited to: chlorotrifluoroethylene (CTFE), ethylene-tetrafluoroethylene (ETFE), perfluorinated ethylene-propylene copolymer (EFEP), ethylene-chlorotrifluoroethylene (ECTFE), $VF_2$, copolymers of tetrafluoroethylene and hexafluoropropene, THV. Vinyl fluoride copolymers that are thermoplastic in nature may also be used.

Most preferably the fluoropolymer is a polyvinylidene fluoride (PVDF). The polyvinylidene fluoride (PVDF) of the invention is PVDF homopolymer, copolymer or polymer alloy. Polyvinylidene fluoride polymers of the invention include the homopolymer made by polymerizing vinylidene fluoride (VDF), and copolymers, terpolymers and higher polymers of vinylidene fluoride, where the vinylidene fluoride units comprise greater than 51 percent by weight, preferably 70 percent of the total weight of all the monomer units in the polymer, and more preferably, comprise greater than 75 percent of the total weight of the monomer units. Copolymers, terpolymers and higher polymers (generally referred to herein as "copolymers") of vinylidene fluoride may be made by reacting vinylidene fluoride with one or more monomers from the group consisting of vinyl fluoride, trifluoroethene, tetrafluoroethene, one or more of partly or fully fluorinated alpha-olefins such as 3,3,3-trifluoro-1-propene, 1,2,3,3,3-pentafluoropropene, 3,3,3,4,4-pentafluoro-1-butene, and hexafluoropropene, the partly fluorinated olefin hexafluoroisobutylene, perfluorinated vinyl ethers, such as perfluoromethyl vinyl ether, perfluoroethyl vinyl ether, perfluoro-n-propyl vinyl ether, and perfluoro-2-propoxypropyl vinyl ether, fluorinated dioxoles, such as perfluoro(1,3-dioxole) and perfluoro(2,2-dimethyl-1,3-dioxole), allylic, partly fluorinated allylic, or fluorinated allylic monomers, such as 2-hydroxyethyl allyl ether or 3-allyloxypropanediol, and ethene or propene. Preferred copolymers or terpolymers are formed with vinyl fluoride, trifluoroethene, tetrafluoroethene (TFE), and hexafluoropropene (HFP).

Preferred copolymers include those comprising from about 60 to about 99 weight percent VDF, and correspondingly from about 1 to about 40 percent HFP; copolymers of VDF and CTFE; terpolymers of VDF/HFP/TFE; and copolymers of VDF and EFEP.

The PVDF of the invention could also be an alloy of PVDF and a miscible, semi-miscible, or compatible polymer. Since most alloys of PVDF result in some diminishment of the PVDF properties, a preferred PVDF is one that is not an alloy. However, small amounts of other polymer, up to 25 percent of the total PVDF polymer alloy may be added. Other fluoropolymers (such as polyvinyl fluoride and PTFE), TPU and (meth)acrylic polymers are examples of useful polymers that may make up a useful polymer alloy.

When the fluoropolymer is to be foamed to reduce the density and increase buoyancy, the stiffness of the foam will be determined by the Tg of the polymer or copolymer, the molecular weight, and the crystallinity. Useful flexual modulus of the polymer can be from less than 20,000, preferably less than 50,000, and more preferably less than 100,000 to greater than 1,000,000 and preferably greater than 750,000 psi. Additives such as glass beads or fibers can be added to increase the modulus and/or reduce the density.

Polyamide

Polyamides useful in the invention include both polyamides and copolyamides. The term "polyamide" is understood to mean products resulting from the condensation:

- of one or more amino acids, such as aminocaproic, 7-aminoheptanoic, 11-aminoundecanoic and 12-aminododecanoic acids or of one or more lactams, such as caprolactam, oenantholactam and lauryllactam;
- of one or more salts or mixtures of diamines, such as hexamethylenediamine, dodecamethylenediamine, metaxylylenediamine, bis-p(aminocyclohexyl)methane and trimethylhexamethylenediamine with diacids such as isophthalic, terephthalic, adipic, azelaic, suberic, sebacic and dodecanedicarboxylic acids.

Copolyamides result from the condensation of at least two alpha,omega-aminocarboxylic acids or of two lactams or of a lactam and of an alpha,omega-aminocarboxylic acid. Mention may also be made of the copolyamides resulting from the condensation of at least one alpha,omega-aminocarboxylic acid (or a lactam), at least one diamine and at least one dicarboxylic acid.

By way of examples of lactams, mention may be made of those having from 3 to 12 carbon atoms in the main ring and possibly being substituted. Mention may be made, for example, of β,β-dimethylpropriolactam, α,α-dimethylpropriolactam, amylolactam, caprolactam, capryllactam and lauryllactam.

By way of examples of alpha,omega-aminocarboxylic acids, mention may be made of aminoundecanoic acid and aminododecanoic acid. By way of examples of dicarboxylic acids, mention may be made of adipic acid, sebacic acid, isophthalic acid, butanedioic acid, 1,4-cyclohexyldicarboxylic acid, terephthalic acid, the sodium or lithium salt of sulphoisophthalic acid, dimerized fatty acids (these dimerized fatty acids have a dimer content of at least 98% and are preferably hydrogenated) and dodecanedioic acid $HOOC—(CH_2)_{10}—COOH$.

The diamine may be an aliphatic diamine having from 6 to 12 carbon atoms or it may be an aryl diamine and/or a saturated cyclic diamine. By way of examples, mention may be made of hexamethylenediamine, piperazine, tetramethylenediamine, octamethylenediamine, decamethylenediamine, dodecamethylenediamine, 1,5-diaminohexane, 2,2,4-trimethyl-1,6-diaminohexane, diamine polyols, isophoronediamine (IPD), methylpentamethylenediamine (MPDM), bis(aminocyclohexyl)methane (BACM) and bis(3-methyl-4 aminocyclohexyl)methane (BMACM).

By way of examples of copolyamides, mention may be made of copolymers of caprolactam and lauryllactam (PA-6/12), copolymers of caprolactam, adipic acid and hexamethylenediamine (PA-6/6,6), copolymers of caprolactam, lauryllactam, adipic acid and hexamethylenediamine (PA-6/12/6,6), copolymers of caprolactam, lauryllactam, 11-aminoundecanoic acid, azelaic acid and hexamethylenediamine (PA-6/6,9/11/12), copolymers of caprolactam, lauryllactam, 11-aminoundecanoic acid, adipic acid and hexamethylenediamine (PA-6/6,6/11/12) and copolymers of lauryllactam, azelaic acid and hexamethylenediamine (PA-6,9/12).

It is possible to use polyamide blends. Advantageously, the relative viscosity of the polyamides, measured as a 1% solution in sulphuric acid at 20° C., is between 1.5 and 5.

Preferred polyamides and copolyamides, include, but are not limited to PA-6, PA-10, PA-11, PA-12, PA-6,6, PA-10,12, PA 6,10 and PA-10,10.

Additives

One or more additives may optionally be added to the fluoropolymer or polyamide composition. Typical additives include, but not limited to, impact modifiers, UV stabilizers, plasticizers, fillers, coloring agents, pigments, dyes, antioxidants, antistatic agents, surfactants, toner, pigments, flame retardant, and dispersing aids. In one embodiment a white pigment is added to help reflect solar radiation in outdoor ponds. An advantage of PVDF is that it is stable against deterioration from UV radiation, so no UV stabilizer is needed.

Foam

Fluoropolymers and polyamides useful for forming polymer foams include crystalline and semi-crystalline fluoropolymers and polyamides that are thermoplastic, as they must melt and flow in polymer extrusion and process molding. By "semi-crystalline", as used herein is meant that the polymer has at least 5% by weight crystalline, and preferably at least 10% crystalline content, as measured DSC. The DSC measurement is run on a 10 mg sample from RT to 210° C. at 20 C/min held for 5 min, cooled from 210° C. to −20° C. at 20° C. per minute, then heated from −20° C. to 210° C. at 10° C. per min. The heat of melting is calculated by standard methods and the percent crystallinity is calculated by dividing the J/g heat of melting by 105 J/g for 100% crystalline PVDF and multiplying by 100. For example, a measurement of 50 J/g heat of melting would mean 47.6% crystallinity.

Branched fluoropolymers and polyamides are especially useful in foam formation, as larger cells can be produced.

Functional fluoropolymers, such as maleic anhydride grafted PVDF (such as KYNAR ADX) from Arkema Inc. may also be used.

The foamed layer(s) can be manufactured through any foaming process including but not limited to the use of physical or chemical blowing agents and nucleating agents. In the case of the chemical blowing agent, the gas is created by decomposition of a chemical by heating it above its degradation temperature. In the case of the physical blowing agent, gas is introduced into the polymer either directly or through evaporating a liquid foaming agent by heating it above its evaporation temperature. Chemical blowing agents are mainly used for higher density foams—down to 70% density reduction, while physical blowing agents can produce light foams—upwards of 10× density reduction.

Blowing agents useful in the invention can be either chemical or physical blowing agents, or a mixture thereof. In the case of a chemical blowing agent, the gas is created by decomposition of a chemical heated above its degradation temperature. In the case of the physical blowing agent, gas is introduced into the polymer either directly or through evaporating a liquid foaming agent by heating it above its evaporation temperature. A combination of chemical and physical blowing agents can also be used.

The chemical blowing agent can be a solid or fluid. Useful blowing agents include, but are not limited to, azodicarbonamide, azodiisobutyronitile, sulfonylsemicarbazide, 4,4-oxybenzene, barium azodicarboxylate, 5-Phenyltetrazole, p-toluenesulfonylsemicarbazide, diisopropyl hydrazodicarboxylate, 4,4'-oxybis(benzenesulfonylhydrazide), diphenylsulfone-3,3'-disulfohydrazide, isatoic anhydride, N,N'-dimethyl-N,N'dinitroterephthalamide, citric acid, sodium bicarbonate, monosodium citrate, anhydrous citric acid, trihydrazinotriazine, N,N'-dinitroso-pentamethylenetetramine, and p-toluenesulfonylhydrazide, or include a blend of or more of said blowing agents. Mixtures of chemical and physical blowing agents are also contemplated by the invention.

The foam of the invention may optionally be formed using a nucleating agent that aids in producing a homogeneous foam. In one preferred embodiment, no added nucleating agent is added. In some cases, a chemical foaming agent could act as both a foaming agent and a nucleating agent. A nucleating agents may be useful when a chemical blowing agent is used and is necessary for forming a controlled foam with physical blowing agents. A mixture of two or more nucleating agents can be used. Useful nucleating agents include, but are not limited to calcium carbonate, calcium sulfate, magnesium hydroxide, magnesium silicate hydroxide, calcium tungstate, silica, calcium oxide, lead oxide, barium oxide, titanium dioxide, zinc oxide, antimony oxide, boron nitride, magnesium carbonate, lead carbonate, zinc carbonate, barium carbonate, calcium silicate, aluminosilicate, carbon black, graphite, non organic pigments, alumina, molybdenum disulfide, zinc stearate, PTFE particles, immiscible polymer particles, and calcium metasilicate. A preferred nucleating agent is calcium carbonate. Nucleating agents that have smaller particle size, and have rougher surfaces are preferred.

In one preferred embodiment, the fluoropolymer foamed structure is produced using one or more master batch concentrate(s) containing an optional nucleating agent, at least one chemical blowing agent in the case where a chemical blowing agent is used, and optional other additives, in a suitable carrier. The purpose of the master batch is to provide a more precise addition of ingredients used at low level, and to do so in a manner providing excellent homogeneous mixing of components within the PVDF, leading to homogeneous foam formation. Moreover, the additives are usually in the form of fine powders that need to be added to the polymer pellets and would phase separate in the extruder hopper.

The master batch contains a high concentration of the required additives in the final product (sometimes 10 to 50 times more concentrated). In one embodiment the master batch contains 1 to 20 weight percent of a blowing agent, and, if present from 0.5 to 20 weight percent of nucleating agent. The master batch is then generally mixed with the PVDF pellets in a dry blend form and introduced in the extruder hopper. This process is called letting down the concentrate. In the let down process, depending on the concentration of the additives in the master batch and also the required amount of the additives in the final product, anything between several percent to sometimes over 50% of the master batch concentrate is added to the polymer resin.

It is possible to have multiple master batches, each containing one or more of the additives to be mixed into the PVDF. One advantage of multiple master batches would be that a manufacturer could adjust the ratio of the additives at the point of manufacture. An example of multiple master batches would be a first master batch containing a nucleating agent, and a second master batch containing a blowing agent.

The foam has good mechanical stability and load bearing properties for PVDF foamed structures having density reductions down to 30% of the original density. The foamed structure has a density that is below that of the liquid it will cover, preferably below 1.0 g/cc, and more preferably from 0.3 to 0.98 g/cc. and more preferably from 0.6 to 0.97 g/cc. The density reduction could be 35% less, 50% less and even as high as 100 times less dense than the non-foamed PVDF material. The foamed PVDF of this invention would have the melt strength to go through sizing and calibration enabling one to form and size the PVDF foam structure to such a close tolerances.

Preferably, the foam cell size is as small as possible. The cell size could be as small as 1 micron. Generally the cell size is in the range of from 10 to 250 microns, more typically in the range of from 50 to 150 microns.

The density of the foam can be controlled by controlling the void space, through adjustment of the process temperature, level of blowing agent, nucleating agents and the cooling procedure for cooling the gas-laden polymer melt (control of the cell growth and final size).

The foam can be extruded into the desired shape or profile and cut to a desired length. In one embodiment, a continuous rod is extruded, and cut into lengths where the length and rod diameter are about equal, producing a marshmallow shaped foam.

Hollow Structures

Another means of producing structures having a fluoropolymer or polyamide outer layer that float on the target liquid is by forming a hollow structure. Hollow structures may be formed from either solid and foamed fluoropolymer or polyamide.

Hollow structures may be formed by means known in the art, such as the injection molding of a PVDF polymer to form two halves of a hollow structure, followed by welding of the halves to form a single hollow structure in the prescribed shape.

A blown film could be formed that is cut and welded (such as by heat) to trap air and form a flexible, polymer "balloon", having a density allowing the structure to float on the liquid, but being amorphous enough to pack tightly with other similar structures providing good surface coverage.

In one embodiment a structure is injection molded or blow-molded into a hollow sphere or any desired shape.

Multi-Layer Structure

Another means of producing a floating structure having a fluoropolymer or polyamide outer layer, is to form a multi-layer structure, wherein the outermost layer is a fluoropolymer or polyamide. Such a structure cold be produced by insert molding, where a thin sheet of fluoropolymer or polyamide is placed in a mold, followed by the injection of a second polymer (such as a polyolefin, or other structural polymer) onto the fluoropolymer or polyamide. If this is formed into half of a hollow structure, two halves can be welded together to forma multi-layer hollow, floating structure, in which all the outside surface is composed of the fluoropolymer or polyamide. Alternatively, a layer or fluoropolymer or polyamide can be placed in the mold, and a foam material (such as a polystyrene or polyurethane, could be injected, and two matching halves could be welded together by known means. The foamed polymer could be designed to result in buoyancy of the whole structure.

In another embodiment, a coextruded sheet having a layer of fluoropolymer or polyamide, and a layer of another thermoplastic polymer, such as, for example, a polyolefin, polyurethane, polyester, polystyrene—either in neat or foamed form is formed. A tie layer could optionally be added between the layers to increase adhesion. The multi-layer sheet could then be thermoformed into half of a hollow structure, with two halves being welded together to form a hollow, floating structure.

In another embodiment, a foamed or hollow structure cold be formed by a less chemical-resistance polymer, followed by coating the structure with a fluoropolymer or polyamide coating. The coating should have a thickness of from 5 to 500 nanometers. In one embodiment, an aqueous polyvinylidene fluoride coating, such as AQUATECH coatings available from Arkema Inc, is applied to a structure such as a hollow polypropylene structure, or a polystyrene foamed structure, to produce a fluoropolymer-coated floating structure.

Shape

The floating fluoropolymer or polyamide structure of the present invention can be of any shape or size. Shapes could be formed in a continuous process (such as the formation of a foamed rod, sheet or profile that is cut and/or formed into multiple structures; or in a batch process, such as injection molding. Some non-limiting examples of useful structures are foamed sheets with a thickness of from 1/16 inch (1.5 mm) to 2 inches (50 mm) and preferably 1/8 inch to 1 inch. The sheet could be cut to fit a small liquid bath as a single piece, or cut into halves, quarters or similar shapes that could be connected on the ends to avoid overlap of the pieces when objects are raised or lowed into the liquid. A foam sheet can be shaped, in-line to various shapes (discs, squares, triangles, hexagons). Shaped floats could then be joined together. Further, a foam sheet could be stamped to any shape, to meet the final application.

In a preferred embodiment, multiple structures as used to provide coverage of a liquid surface. This provides a covering that is more flexible and able to cover any given geometry of the liquid surface. It also provides flexibility for easy entry and egress from the liquid bath, pool or pond.

A foam semi-cooled rod could be formed into unique shapes using forming tools, including but not limited to spheres, pillow-shaped, oblong shapes.

While there is no limit to the size and shape of useful structures. Structures could be as small as 0.1 mm in diameter, width or length, up to several meters in diameter or length. Some preferred sizes for applications in which multiple structures are used to cover a liquid for a length, width or diameter are from 0.1 mm to 10 meters, preferably from 1 mm to 1 meter, more preferably from 2 mm to 500 cm, and more preferably from 5 mm to 50 cm—depending on the end-use application. The ideal structure is one that provides maximum coverage of the liquid surface. Some non-limiting examples include:

- Spheres, either hollow or foam, which are easy to form and provide full coverage of any surface area shape. The disadvantage being that there are many gaps in the surface coverage between the spheres.
- Foamed or hollow polygons, for example triangles, squares, hexagons, octagons and other shapes that can align with each other to provide an almost complete coverage of the surface. As seen in the cited art, hexagons are especially favored, and preferably include a 3-dimensional cone or pyramid shape to prevent overlap.
- Foamed or hollow disks, or other relatively flat shapes that can lay flat on the surface, and may have wings, or overlapping surfaces to reduce gaps between the discs. Flatter structures have advantages of requiring less material, and not easily overturning where the top can rotate to the bottom, bring dirt from the atmosphere into the liquid.
- Marshmallow shaped foam, can be easily formed by foaming a rod structure that is cut into many small lengths. Preferably the length of the marshmallow is within +/−50 percent, preferably +/−25 percent, and more preferably +/−10 percent of the diameter of the marshmallow.
- winged rods, with the wings preventing rolling in the liquid.
- amorphous "balloon" shaped hollow structures can be formed from blown film tubes that are cut and sealed on both ends to trap air. These can be packed together to provide almost complete surface coverage.
- a foam sheet could be formed, and cut into shapes—such as cubes or boxes, of any desired size.
- a winged sphere, foamed or hollow, in a Saturn-shape having a rim around the diameter, provides a means to prevent rolling, and allow for overlap of the rings for improved surface coverage.

Properties of the Floating Structures

The density of the structures of the invention can be adjusted to be less than that of the liquid it is to cover to provide buoyancy. While the polymer structures of the invention are designed to "float" on the surface liquid, it can be preferable for the structure to extend through the surface (be partially above and partially below), as this can help reduce loss of the structures due to wind. Preferred density difference between the structure and the liquid is in the range of 2 to 50 percent below that of the liquid, and preferably from 10 to 25 percent below. Foams having a density of from 0.3 to 0.98 and preferably from 0.5 to 0.97, more preferably from 0.6 to 0.95 are a preferred embodiment.

Use

Since the structures of the invention float on the liquid they are covering, they reduce the level of evaporation, reduce the release of noxious or toxic vapors, provide safety for workers from chemical reactions and misting that occur during processing with a chemical bath, act as a thermal insulator, prevent contamination from entering the bath (such as for example dirt, birds and other wildlife, bugs), deter wildlife from entering or drinking the liquid, and serve to retard biological growth.

In one embodiment, when many small floating structures are used on the top of an acid bath (such as chroming bath with nitric acid), parts can easily be placed into the bath between the floating structures, and the structures then back-fill across the opening in the surface to prevent misting due to the chemical reaction. This adds a level of safety to the industrial application.

The floating structures of the invention may be used in water reservoirs and ponds, pools, in chemical waste ponds, chemical processing baths, waste-water treatment reservoirs, and chemical processing ponds, including but not limited to mining operations, oil field operations, and fracking chemical pools.

EXAMPLES

PVDF homopolymer foam rods were produced having densities between 0.707 g/cc and 0.9754 g/cc, using KYNAR FLEX 2620 FC foam concentrate with polyvinylidene homopolymers and copolymers, such as KYNAR 760, KYNAR 450, KYNAR 460 and KYNAR 3120-50 resins from Arkema Inc. The foam rods were made at a rate of up to 70 ft/minute, and were cooled and cut into short, marshmallow shaped structures.

Example 1

Using KYNAR 760 resin and 8 wt % of KYNAR FLEX 2620 FC foam concentrate, a foam rod of about 0.20 inch diameter was extruded at 66 ft/min. The rod had a density of 0.93 g/cm$^3$—a 47% density reduction. The extruder conditions were as follows:

| Barrel (° F.) | | | | Die (° F.) | | | Head | | Line speed | |
|---|---|---|---|---|---|---|---|---|---|---|
| 1 | 2 | 3 | 4 | 1 | 2 | 3 | (psi) | Amps. | (ft/min.) | RPM |
| 390 | 390 | 430 | 450 | 460 | 460 | 460 | 1280 | 72% | 66 | 40 |

Example 2

One would add Kynar Flex® 2800 resin to an extrusion blow molding extruder, and extrude a parison at extruder temperatures ranging from 400° F. at the feed throat and ascending in temperature up to 480° F. at the metering zone on the extruder. The adapter and die temperatures can be constantly held at 480° F. The parison will flow at a screw speed of about 10 revolutions per minute. The mold will then close on the parison and internal air pressure will form the parison to the cavity of the mold forming into a large hollow shape. If there is an opening through the wall of the hollow part, and Kynar Flex® 2800 film can be placed over the hole. Using a heated face at 300° F., the film can be welded over the hole sealing in the air. The air trapped inside of the molded product allows buoyancy to float on water.

Example 3

One would add Kynar Flex® 3120-10, Kynar Flex® 2800-20 or Kynar® 740 resin into an extruder and extrude a film at extruder temperatures ranging from 400° F. at the feed throat and ascending in temperature up to 450° F. at the metering zone on the extruder. The adapter and die temperatures can be constantly held at 450° F. The extruder RPM can be held at 10 revolutions per minute with a line speed of 5-8 ft/min. The roll stacks can be controlled at 150° F. temperature. The film can then be collected on a winder. Once the film is formed, then the film can be cut to size and thermally welded. For example, two Kynar Flex® 2800-20 10"×10" square film samples can be cut to size and laid directly on top of each other. Using a thermal welding heat sealer, one could heat the sealer to 300° F. place and one side at a time of the 10"×10" sample into the welder. Once three of the four sides are welded, one could add air in between the 10"×10" sheets so that air is trapped inside the bag and then heat seal the fourth edge making a square article with air trapped in the center which allows buoyancy to float on top of water.

Example 4

One would add Kynar Flex® 3120-50 with a 6 wt % loading of Kynar Flex® 2620FC to an extruder and extrude a foamed sheet at extruder temperatures ranging from 380° F. at the feed throat and ascending in temperature up to 420° F. at the metering zone on the extruder. The adapter and die temperatures can be constantly held at 360° F. The extruder RPM can be held at 10 revolutions per minute with a line speed of 5-8 ft/min. The roll stacks can be controlled at 150° F. temperature. The closed cell sheet can then be collected on a winder. Once the sheet is cooled, then the sheet can be cut to size and thermoformed to shape. For example, two Kynar Flex® 3120-50 10"×10" square foamed sheet samples can be cut to size and be thermoformed into a bowl shape. The two shapes can be edge trimmed and placed so that the top of the bowls are in contact. A butt fusion or IR welder can be used to melt the interfacial areas at the top of the bowls and sealed by pressing molten parts together producing a completely welded interface between the two bowls, taking on the shape of welded sphere with air trapped inside. The foamed sphere with air trapped in the center allows buoyancy to float on top of water. See FIG. 1.

Example 5

Using a blend of 70 wt % Kynar®760 and 30 wt % PMMA V825 a hollow cylindrical structure can be thermally extruded using 8 wt % of Kynar Flex® 2620FC foam concentrate additive. The extrusion conditions to be set at the conditions below.

| Barrel (° F.) | | | | Die (° F.) | | | Head | Line speed | |
|---|---|---|---|---|---|---|---|---|---|
| 1 | 2 | 3 | 4 | 1 | 2 | 3 | (psi) | (ft/min.) | RPM |
| 350 | 375 | 400 | 425 | 355 | 355 | 355 | 780 | 13.2 | 14.6 |

The gas-laden melt extrudate is cooled and formed in a water vacuum cooling tank with a water temperature of 100° F. The solid hollow cylinder can then be cut to length. The density of this final product is 49.67% density reduction (0.760 g/cc) making it a very buoyant product. To further improve the buoyancy, the open ends of the hollow cylinder can be welded shut using a thermal heat sealer set to 450° F. and clamp closed for 5 seconds to allow the two molten interfaces to come into contact. The clamp is then reopened and the molten section is allowed to cool and solidify producing a hollow buoy with air sealed inside which has a density less then water.

Example 6

Using a blend of Kynar Flex® 2800-00 and 5 wt % of Azo based Kynar® PVDF foam concentrate, one can extrude a foamed parison where the density of the gas-laden melt is 28.26% density reduction (1.2841 g/cc) using the following conditions:

| Barrel (° F.) | | | | Die (° F.) | | | Head | Line speed | |
|---|---|---|---|---|---|---|---|---|---|
| 1 | 2 | 3 | 4 | 1 | 2 | 3 | (psi) | (ft/min.) | RPM |
| 315 | 380 | 410 | 310 | 315 | 315 | 315 | 2000 | 2.9 | 40 |

The foamed parison does not have low enough density to float on water by itself, so the parison can then be heat sealed on one side using a thermal heat sealer set to 450° F. and clamp closed for 5 seconds to allow the two molten interfaces to come into contact. The clamp is then reopened and the molten section is allowed to cool and solidify. The structure is now sealed on three sides, before sealing the four and final side, air can be blown into the bag and then the heat sealer can close and thermally seal the four edge to trap the air creating a foamed air pillow buoy which has a density less then water.

What is claimed is:

1. A chemical resistant floating structure for reducing the level of evaporation from a liquid, comprising a fluoropolymer foam, where the density of the structure is from 0.3 to 0.98 g/cc, wherein said fluoropolymer is a polyvinylidene fluoride homopolymer or copolymer having at least 70 weight percent of vinylidene fluoride monomer units.

2. The structure of claim 1 wherein the density of the structure is from 0.3 to 0.98 g/cc.

3. The structure of claim 1, wherein said structure is a hollow structure.

4. The structure of claim 1, wherein said structure is in the shape of a marshmallow, cube or box.

5. The structure of claim 4, wherein said marshmallow-shape structure has a diameter of from 0.5 to 12 inches, and a length of from 0.5 to 12 inches, wherein said length is within +/−25% of the diameter.

6. The structure of claim 1, wherein said structure is in the shape of a polygon.

7. The structure of claim 6, wherein said structure is in the shape of a hexagon.

8. A partially or fully covered body of liquid, comprising a liquid body, having floating thereon one or more chemically resistant structures of claim 1.

9. The covered body of liquid of claim 8, wherein said floating structure comprises two or more discrete floating structures.

10. The covered body of liquid of claim 8, wherein said fluoropolymer is a polyvinylidene fluoride homopolymer or copolymer having at least 70 weight percent of vinylidene fluoride monomer units.

11. A method for reducing the evaporation from a liquid comprising;

a. forming the structure of claim 1, b. placing one or more of the structures on the top of a fluid to partially cover the fluid surface.

12. The method of claim 11, wherein said fluid comprises an acid, base, oxidizing agent, toxic chemical, or corrosive chemical.

* * * * *